US005116047A

United States Patent [19]

Phelan et al.

[11] Patent Number: 5,116,047

[45] Date of Patent: May 26, 1992

[54] GOLF PUTTING DEVICE AND METHOD

[76] Inventors: Herbert A. Phelan; Stella Phelan; Patricia A. Guimont, all of 2543 W. Catalina, Phoenix, Ariz. 85017

[21] Appl. No.: 539,184

[22] Filed: Jun. 18, 1990

[51] Int. Cl.[5] ..... A63B 53/04

[52] U.S. Cl. ..... 273/80.1; 273/80 A; 273/80.2; 273/78; 273/171; 273/167 F

[58] Field of Search ..... 273/79, 80.1, 80.2, 273/164, 78, 167–175, 193 R–194 B, 80 A; 15/144 R, 145, 176.1, 176.3; 403/362; D21/219

[56] References Cited

U.S. PATENT DOCUMENTS

| | | | |
|---|---|---|---|
| D. 137,283 | 2/1944 | Jakosky | 273/168 |
| D. 139,462 | 11/1944 | Jakosky | 273/79 |
| 269,755 | 12/1882 | Weiss | 403/362 X |
| 509,237 | 11/1893 | Olsen et al. | 15/160 |
| 1,334,189 | 3/1920 | Swanson | 273/80.1 |
| 1,585,294 | 5/1926 | Link | 273/174 |
| 2,299,735 | 10/1942 | Birkhofer | 273/80.8 |
| 2,815,989 | 12/1957 | McCrink | 15/145 X |
| 3,392,977 | 7/1968 | Delacey | 273/80.1 |
| 3,397,888 | 8/1968 | Springer et al. | 273/80.1 |
| 3,682,516 | 8/1972 | Savage | 273/80.1 X |
| 3,841,640 | 10/1974 | Gaulocher | 273/78 X |
| 4,884,808 | 12/1989 | Retzer | 273/173 X |

FOREIGN PATENT DOCUMENTS

| | | | |
|---|---|---|---|
| 646942 | 8/1962 | Canada | 273/80.1 |
| 304008 | 1/1929 | United Kingdom | 273/169 |

*Primary Examiner*—William H. Grieb
*Assistant Examiner*—Sebastiano Passaniti
*Attorney, Agent, or Firm*—Harry M. Weiss

[57] ABSTRACT

A golf putter adaptable to form a left handed putter or a right handed putter. The putter includes a handle having a bottom end connector shank, and includes a head having a left connector hole for receiving the shank for forming a left handed putter and having a right hole for receiving the shank for forming a right handed putter.

4 Claims, 1 Drawing Sheet

GOLF PUTTING DEVICE AND METHOD

BACKGROUND OF THE INVENTION

1. Field of Invention

The invention generally relates to a golf putter and method, and, in particular, the invention relates to a golf putter and method which is adaptable to suit both a right handed golfer and a left handed golfer.

2. Description of the Prior Art

The prior art golf putter has a head and handle which are fixedly connected together and which are configured to suit, in particular, either a right handed golfer or a left handed golfer, but not both a right handed golfer and a left handed golfer.

One problem with the prior art golf putter is that a manufacturer of golf putters must have and/or provide a first supply of right handed golf putters and a second supply of left handed golf putters.

SUMMARY OF THE INVENTION

According to the present invention, a golf putter is provided. This golf putter comprises a handle having a shank portion and a head having a plurality of identical holes, each of which can receive and be fixedly connected to the shank portion.

By using the plurality of identical holes, each of which can receive and be fixedly connected to the shank portion, the handle and head can be connected, so as to suit either a right handed or a left handed type of golfer, thereby avoiding the need for more than one supply of golf putters.

The foregoing and other objects, features and advantages will be apparent from the following description of the preferred embodiment of the invention as illustrated in the accompanying drawings.

DESCRIPTION OF THE PREFERRED EMBODIMENT

Figure 1:
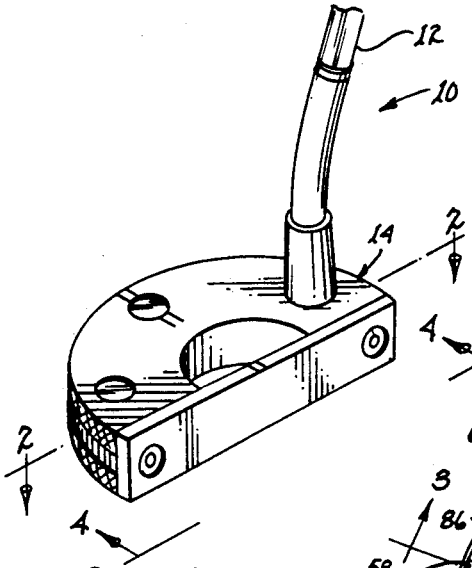
FIG. 1 is a perspective view of a golf putter according to the present invention.

As shown in FIGS. 1 through 6, a golf club or golf putter 10 is provided. Putter 10 has a handle 12 and a head 14. Handle 12 has a top grip portion 16, an intermediate elongate portion 18, and a bottom connector portion 20 (see FIG. 4). Portions 16, 18, 20 are axially disposed along a handle axis 22. Bottom portion 20 has an enlarged or flange portion 24 and a projecting shank portion 26. Bottom portion 20 is slightly curved.

Head 14 has an arcuate or semicylindrical portion 28 with a uniform thickness, and has a flat blade portion 30 with a uniform thickness and width. Blade 30 is a removable blade. The thickness and type of metal used in blade 30 determines the resiliency of blade 30, under an impact load, upon hitting a golf ball. In this embodiment, the metal of arcuate portion 28 and blade 30 is preferably made of a metal such as steel or aluminum or a metal alloy.

Figure 2:
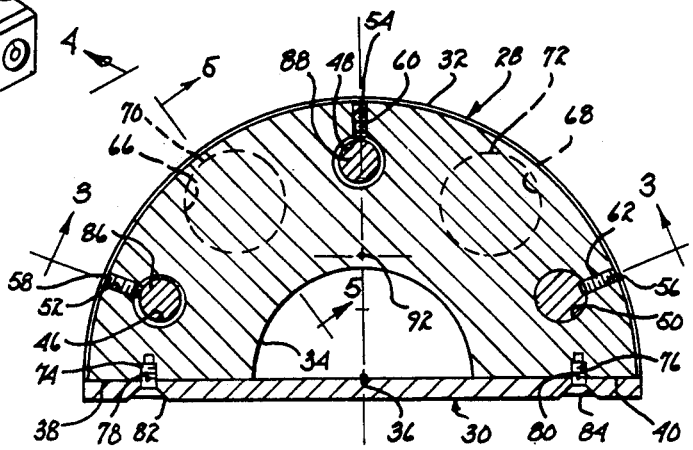
FIG. 2 is a section view as taken along the line 2—2 of FIG. 1.
Figure 3:
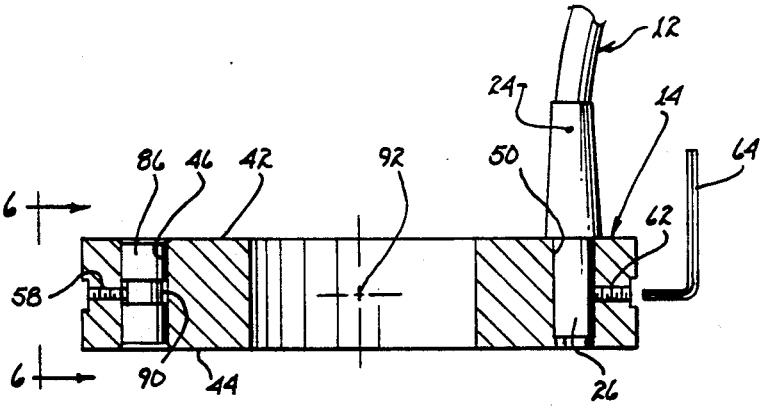
FIG. 3 is a section view as taken along the line 3—3 of FIG. 2.

As shown in FIGS. 2 and 3, arcuate portion 28 has an outer cylindrical surface 32 and an inner cylindrical surface 34, both of which are concentric about a center axis 36. Arcuate portion 28 also has opposite end faces 38, 40, which are disposed in a plane passing through center axis 36. Arcuate portion 28 also has a top surface 42 and a bottom surface 44 (see FIG. 3).

Figure 6:
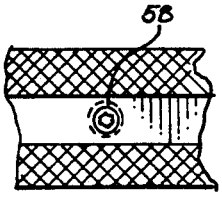
FIG. 6 is an elevation view as taken along the line 6—6 of FIG. 3.
Figure 4:
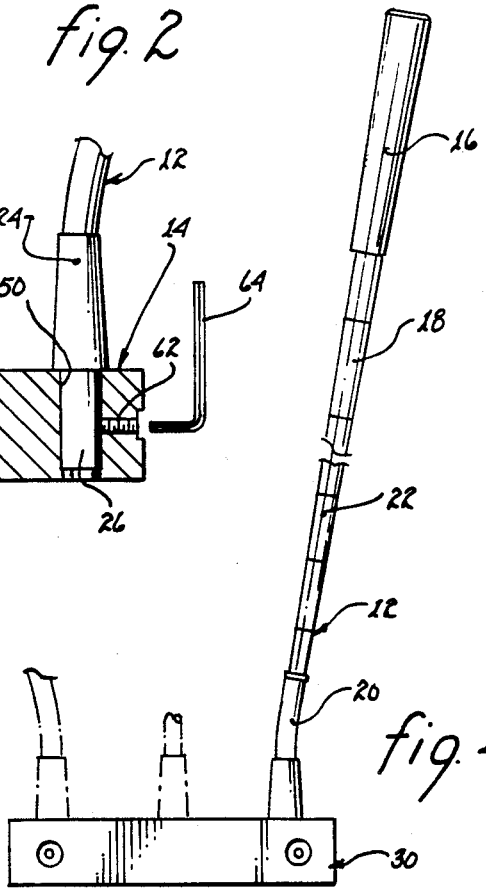
FIG. 4 is an elevation view as taken along the line 4—4 of FIG. 1.

As shown in FIGS. 2, 3 and 6, top surface 42 has three connector holes 46, 48, 50, each of which can receive and be connected to shank 26. Hole 50 is used for connection to shank 26 for a right hand putter for a right handed golfer. Hole 46 is used for a left handed golfer or putter. Hole 48 is used for both a right handed putter and a left handed putter.

Outer cylindrical surface 32 has three threaded holes 52, 54, 56, which respectively have three lock screws 58, 60, 62. Screws 58, 60, 62 are turned by an L-shaped screw driver 64 which is shown disposed adjacent to screw 62. Screws 58, 60, 62 are disposed respectively at right angles to the axes of holes 46, 48, 50, for gripping shank 26 when disposed within one of the holes 46, 48, 50.

Figure 5:
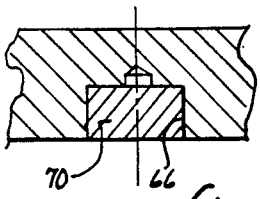
FIG. 5 is a section view as taken along the line 5—5 of FIG. 2.

As shown in FIGS. 2 and 5, bottom surface 44 has two recesses 66, 68 which respectively have balance weights 70, 72 disposed therein. The thickness of weights 70, 72 are respectively chosen to suit the balance of the putter 10 and head 14, and to suit the choice of a particular golfer.

As shown in FIG. 2, end faces 38, 40 have respective threaded holes 74, 76, which receive respective screws 78, 80, that pass through respective holes 82, 84 in blade 30, for connecting blade 30 to arcuate portion 28.

As shown in FIG. 3, the empty or unused holes, 46, 48 have respective plugs 86, 88, when shank 26 is in hole 50. Plus 86, like plug 88, has an annular groove 90, which receives the end of screw 58. Plugs 86, 88 are used for balancing head 14, and for keeping mud out from holes 46, 48. Head 14 has a center of gravity 92, which is disposed about in a plane, that extends through center axis 36 and that is normal to a plane extending through end faces 38, 40. Center of gravity 92 is also disposed about midway between top surface 42 and bottom surface 44.

Putter 10 helps a golfer to hit the golf ball so that the center of gravity 92 and axis 36 of head 14 are in the same plane as a point of contact and a center of gravity of the golf ball, thereby preventing twisting of the head 14 and helping the golfer to improve their accuracy.

Advantages of putter 10 are indicated hereafter.

a) golf putter 10 is adaptable to both a right handed golfer and a left handed golfer.

b) putter 10 permits an easy alignment or orientation of handle 12 to suit the golfer's perception of a straight line from the face of the club to the hole or cup or a predetermined spot.

c) Blade 30, which is a resilient beam, provides a spring-back force increment on impact with a golf ball for greater travel of the golf ball.

d) putter 10 is easily assembled by hand to suit a right handed golfer or a left handed golfer.

The method of manufacture of putter 10 includes the steps as indicated hereafter.

a) form a handle 12 having a bottom shank portion 26.

b) form a head 14 having a plurality of connector holes 46, 48, 50, each of which can receive the shank portion 26.

c) connect the shank portion 26 within one of the connector holes 46, 48, 50 by tightening a respective connector 58, 60, 62, to form a right handed putter or a left handed putter.

While the invention has been described in its preferred embodiment, it is to be understood that the words which have been used are words of description rather than limitation and that changes may be made within the purview of the appended claims without departing from the true scope and spirit of the invention in its broader aspects.

The embodiments of an invention in which an exclusive property or right is claimed are defined as follows:

I claim:

1. A golf putter comprising:

a golf putter handle having a bottom connector portion;

a golf putter head having a top surface having a plurality of holes, each of which extends vertically down from said top surface and can receive and connect to said bottom connector portion;

aperture means located on a side of said head and in communication with each of said plurality of holes for permitting a member insertable within said aperture means to engage or disengage with said bottom connector portion to respectively provide a quick attach - quick detach assembly for said bottom connector portion;

said handle comprising:

a top grip portion;

an intermediate elongate portion connected to the top grip portion at one end thereof and connected to the bottom connector portion at the other end thereof;

said bottom connector portion having an enlarged flange portion and a shank portion projecting therefrom;

said head comprising:

an arcuate portion;

a removable blade connected to the arcuate portion;

said arcuate portion having a center axis having a radially distanced outer semicylindrical surface and having a radially distanced inner semicylindrical surface and having opposite end faces disposed in a plane extending through the center axis;

said blade having two removable connectors respectively connected to the end faces;

said arcuate portion having a top surface and a bottom surface; and said top surface having a left hole for receiving the shank portion for forming a left handed putter and having a right hole for alternately receiving the shank portion for forming a right handed putter and having a central hole for selectively receiving the shank portion for forming either a left handed putter or a right handed putter.

2. The putter of claim 1, wherein said head has a center of gravity disposed about midway between the top surface and the bottom surface, and disposed in a plane extending through the center axis and normal to a plane including the end faces.

3. The putter of claim 1, wherein two of the three connector holes have a respective plug, and all three connector holes have respective lock screws.

4. The putter of claim 3, wherein said bottom surface has two recesses for respective balancing weights.

* * * * *